US005720839A

United States Patent [19]

Takahashi et al.

[11] Patent Number: 5,720,839

[45] Date of Patent: Feb. 24, 1998

[54] THERMAL TRANSFER RECORDING MEDIUM

[75] Inventors: Shigeki Takahashi; Shuji Maruyama; Ryuma Mizushima; Shinichi Yabe; Atsushi Suzuki, all of Tochigi, Japan

[73] Assignee: Kao Corporation, Tokyo, Japan

[21] Appl. No.: 620,700

[22] Filed: Mar. 21, 1996

[30] Foreign Application Priority Data

Mar. 22, 1995 [JP] Japan ..... 7-062593

[51] Int. Cl.[6] ..... B41M 5/26

[52] U.S. Cl. ..... 156/230; 156/277; 400/196; 427/256; 428/195; 428/212; 428/216; 428/423.1; 428/484; 428/488.4; 428/522; 428/913; 428/914

[58] Field of Search ..... 428/195, 207, 428/211, 484, 488.4, 913, 914, 212, 216, 423.1, 522; 347/217; 156/230, 277; 427/256; 400/196

[56] References Cited

U.S. PATENT DOCUMENTS 5,072,234 12/1991 Crystal et al. ..... 428/484

5,171,639 12/1992 Mecke et al. ..... 428/484

5,605,766 2/1997 Arimura et al. ..... 428/488.4

FOREIGN PATENT DOCUMENTS 62-68786 3/1987 Japan .

*Primary Examiner*—Pamela R. Schwartz

*Attorney, Agent, or Firm*—Oblon, Spivak, McClelland, Maier & Neustadt, P.C.

[57] ABSTRACT

A thermal transfer recording medium is disclosed, comprising a substrate having thereon a wax release layer, and a heat-fusible ink layer provided on the wax release layer, wherein the wax release layer has a maximum probe tack of from 0.1 to 60 gf in a temperature range of 40° to 150° C. as measured in accordance with ASTM D2979. The thermal transfer recording medium enables low-energy printing without causing background stains and exhibits high transfer sensitivity to provide a transferred image with improved durability and improved print quality.

15 Claims, 1 Drawing Sheet

THERMAL TRANSFER RECORDING MEDIUM

BACKGROUND OF THE INVENTION

1. Field of the Invention

This invention relates to a thermal transfer recording medium, particularly a thermal transfer recording medium to be used in an ink ribbon cassette, more particularly a thermal transfer recording medium capable of providing a transferred image having improved durability and print quality.

2. Discussion of the Background

A thermal transfer recording system is a system using a thermal transfer recording medium comprising a sheet substrate having formed thereon at least one heat-fusible ink layer, in which the heat-fusible layer of the thermal transfer recording medium is brought into contact with a material to which an image is to be transferred (a transferee material), and the heat-fusible ink layer is melted by heat applied by a thermal head from the substrate side to transfer an ink image to the transferee material. The thermal transfer recording system is advantageous in that a device for use therein is quiet and is easy to operate and maintain, and it is capable of using plain paper as a transferee material. Thus, the thermal transfer recording system has recently been widely used.

Usually, a thermal printer provided with a thermal head is used in the thermal transfer recording for recording an image onto plain paper and the like. With the advancement of the thermal printer in performance, it has been demanded to minimize heat energy required for printing. Reduction in heat energy for printing will make it feasible to reduce the heating and cooling cycle time of the head, to prevent deterioration of the head by heat, and, especially in the case of line printers to reduce the size of a power source. Compensation for insufficiency of heat resistance of the substrate could also be brought about. However, if an ink composition is designed to have such a low melting point so as to reduce the heat energy necessary for printing, background stains would occur in printing on paper due to a low-melting component of the ink composition. Reduction in fixing properties and durability of a transferred image would also result. Further, when the surrounding temperature rises, a so-called blocking phenomenon could also occur.

These problems have been coped with by introducing a resinous component into a binder of a heat-fusible ink layer as disclosed in JP-A-54-87234 (the term "JP-A" as used herein means an "unexamined published Japanese patent application"), JP-A-54-163044, JP-A-56-98269, and JP-A-62-130887, or by coating a wax ink layer with a resin-based overcoat layer as proposed in JP-A-61-242893. However, none of these types of thermal transfer recording media has succeeded in fulfilling the complex demand in good balance.

It has also been suggested to reduce the thickness of the substrate to increase heat conductivity for achieving low energy printing, but such an attempt is accompanied by reduction in covering power in solid image areas or making running properties unstable.

SUMMARY OF THE INVENTION

An object of the present invention is to provide a thermal transfer recording medium which achieves low energy printing without causing background stains, exhibits high transfer sensitivity, and provides a transferred image with improved durability and print quality.

As a result of extensive investigations, the inventors of the present invention have found that a transferred image having improved durability and print quality can be obtained with high transfer sensitivity even with low heat energy applied, by providing a wax release layer between a substrate and a heat-fusible ink layer to control release characteristics of the heat-fusible ink layer.

The present invention has been completed based on the above finding. That is, the above object of the present invention can be accomplished by a thermal transfer recording medium comprising a substrate having thereon a wax release layer and a heat-fusible ink layer provided on the wax release layer, wherein the wax release layer has a maximum probe tack of from 0.1 to 60 gf at a temperature of 40° to 150° C. as measured in accordance with ASTM D2979 (or JIS Z0237).

One characteristic feature of the thermal transfer recording medium of the present invention is a specific wax release layer provided between a substrate and a heat-fusible ink layer to control release characteristics of the heat-fusible ink layer. In the thermal transfer recording medium of the present invention, improvement in release characteristics of the heat-fusible ink layer can be made by adjusting the maximum probe tack of the wax release layer to 0.1 to 60 gf in a temperature range of from 40° to 150° C. as measured according to ASTM D2979. It follows that the thermal transfer recording medium of the present invention has improved transfer sensitivity to provide a transferred image with improved durability and print quality.

BRIEF DESCRIPTION OF THE DRAWINGS

A more complete appreciation of the invention and many of the attendant advantages thereof will be readily obtained as the same becomes better understood by reference to the following detailed description when considered in correction with the accompanying drawings, wherein.

DETAILED DESCRIPTION OF THE PREFERRED EMBODIMENTS

The thermal transfer recording medium of the present invention comprises a substrate, a wax release layer provided on the substrate, and a heat-fusible ink layer provided on the wax release layer. The present invention will be described below in detail with reference to these elements.

The substrate material preferably has high heat-resistant strength, dimensional stability and surface smoothness. Any material capable of forming a substrate can be used with no particular limitation. Examples of suitable materials include polyolefins, such as polyethylene and polypropylene; polyesters, such as polyethylene terephthalate; polyamides, such as nylon; polyimides; chlorine-containing resins, such as polyvinyl chloride and polyvinylidene chloride; polystyrene resins, such as polystyrene and derivatives thereof; fluorine-containing resins, such as polytetrafluoroethylene; polycarbonates; papers such as glassine paper and condenser paper; and metal foils. Substrates made of a blend of these resins or composite substrates composed of different laminate of these materials can also be used. Suitable substrates may be prepared by conventional methods known to those of ordinary skill in the art. A substrate formed of polyethylene terephthalate may preferably be used in the present invention since it has strong nerve, wrinkle resistance, and excellent heat resistance. While not limiting, the substrate preferably has a thickness of about 0.5 to 20 μm, more preferably 0.5 or more and smaller than 3.0 μm.

The wax release layer has a maximum probe tack of 0.1 to 60 gf at 40° to 150° C. as measured according to ASTM D2979. This release characteristic of the wax release layer brings about improved release of the heat-fusible ink layer, which leads to improvement in transfer sensitivity, durability of the transferred image and print quality. If the maximum probe tack of the wax release layer is less than 0.1 gf, the transfer properties are deteriorated. If it exceeds 60 gf, the release properties are reduced thereby impairing running properties. The maximum probe tack is preferably 1 to 50 gf, more preferably 1 to 40 gf.

Figure 1A:
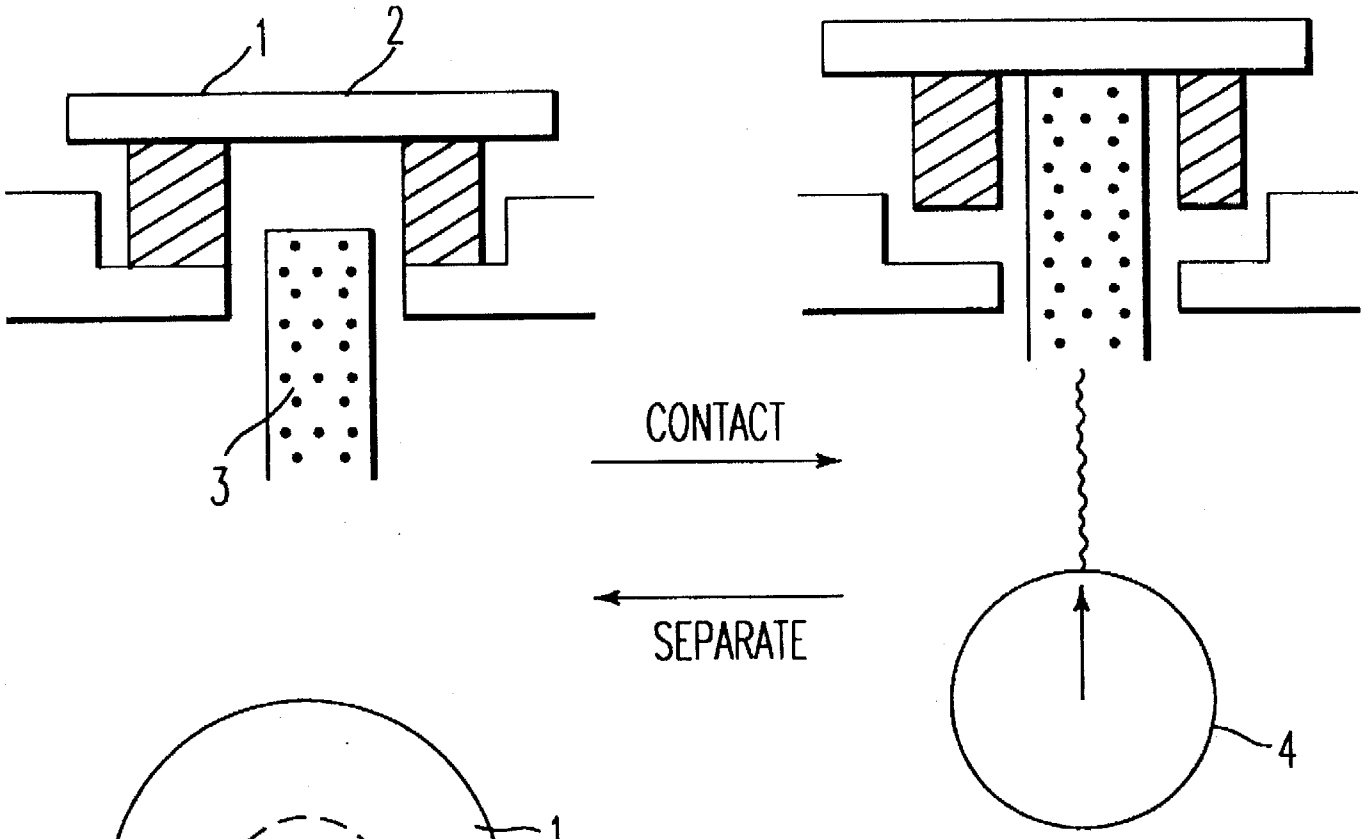
FIG. 1(A) is a schematic illustration of an apparatus for measuring a probe tack.
Figure 1B:
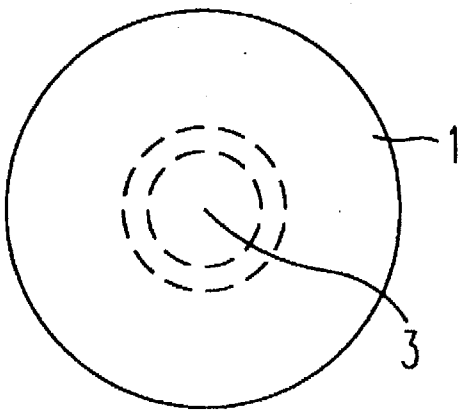
FIG. 1(B) shows the contact condition of a probe on the surface of a sample.

The probe tack is determined by the method specified in ASTM D2979. That is, as shown in FIG. 1(A), probe 3 of 5.1 mm in diameter is brought into contact with adhesive surface 2 of test piece 1 for a predetermined period of time, and the force required for separating the probe is measured with gauge 4.

The probe tack is a value measured under conditions of a contact load of 300 gf/cm$^2$, a contact time of 0.1 second, and a separation rate of 120 mm/sec.

The wax release layer contains a wax component and serves for improving the release properties of the heat-fusible ink layer. The wax component is not particularly limited, and any wax component can be used as long as it has a maximum probe tack of 0.1 to 60 gf at 40° to 150° C. as measured according to ASTM D2979. Specific examples of suitable wax components include polyethylene wax, paraffin wax, rice bran wax, microcrystalline wax, carnauba wax, shellac wax, montan wax, higher fatty acids (i.e., $\geqq C_2$ fatty acids), higher fatty acid amides (i.e., $\geqq C_2$ fatty acid amides), and higher alcohols (i.e., $\geqq C_2$ alcohols). These wax components may be used either individually or as a combination of two or more thereof. Of these wax components, preferred are one or more kinds selected from the group consisting of polyethylene wax and paraffin wax. In particular, polyethylene wax is preferred in view of the running properties of the ink ribbon during low energy printing.

Suitable polyethylene wax may be prepared by conventional methods known to those ordinary skill in the art. The polyethylene wax includes one prepared by polymerization of ethylene, one obtained by thermal degradation of polyethylene for general molding, one obtained by separating and purifying low-molecular polyethylene by-products from the production of polyethylene for general molding, and one obtained by oxidation of polyethylene for general molding. Polyethylene waxes obtained by polymerization at high temperature under high pressure in the presence of a radical catalyst or under low pressure in the presence of a Ziegler catalyst are especially preferred since its particle size distribution and molecular weight can be adjusted within a narrow range.

Polyethylene wax available on the market, such as MITSUI HI WAX (available from Mitsui Petrochemical Industries, Ltd.), A-WAX (available from BASF AG), AC-POLYETHYLENE (available from Allied Signal), EPOLENE (available from Eastman Kodak Co.), HOECHST WAX (available from Hoechst AG), SAN WAX (available from Sanyo Chemical Industries, Ltd.), BARECO WAX (available from Bareco), SASOL WAX (available from Sasol), and POLYWAX (available from Toyo Petrolite Co., Ltd.), can also be used.

Besides having a maximum probe tack of 0.1 to 60 gf at 40° to 150° C. according to ASTM D2979, the wax component preferably has a melt viscosity of less than 15 cP at 100° C. If the melt viscosity at 100° C. is 15 cP or higher, the increased releasing force during printing tends to impair running properties of the thermal transfer recording medium. It is still preferable that the melt viscosity is less than 12 cP, especially less than 7 cP, at 100° C. The melt viscosity of the wax component generally depends on the molecular weight and density.

It is also preferable for the wax component to have a dropping point of not higher than 100° C. as measured according to ASTM D-3104. If the dropping point is higher than 100° C., the increased releasing force during low energy printing tends to influence the running properties of the ink ribbon adversely. A still preferred dropping point of the wax component is 98° C. or lower.

In order to improve coating film strength or softness of the wax release layer, the wax release layer may further comprise one or more resins, such as an ethylene-vinyl acetate copolymer, an ethylene-acrylic acid copolymer, polyethylene resins, and petroleum resins, in such an amount that would not impair the effects of the present invention.

While not limiting, it is generally preferable that the wax release layer contains 1 to 100% by weight, preferably 20 to 99% by weight, of the wax component and 0 to 50% by weight, preferably 1 to 20% by weight, of the above-mentioned resin, based on the weight of the wax release layer.

While not limiting, it is generally preferable that the wax release layer has a thickness of 0.1 μm or more and less than 5.0 μm, particularly 0.1 μm or more and less than 3.0 μm; for, within this thickness range, the releasing force is reduced to ensure improvement in transfer sensitivity.

In a particularly preferred embodiment, the wax release layer has a thickness of 0.1 μm or more and less than 3.0 μm, while the substrate has a smaller thickness than usual, i.e., 0.5 μm or more and less than 3.0 μm. In this case, not only is transfer sensitivity improved but running stability of the thermal transfer recording medium is further improved.

The heat-fusible ink layer, which is provided on the wax release layer, generally contains a colorant and a binder. The heat-fusible ink layer is softened and melted upon heating and transferred to a transferee material.

Any colorant known to those of ordinary skill in the art may be used. Examples of the colorant which can be used in the heat-fusible ink layer includes black dyes and pigments, e.g., carbon black, Oil Black, and graphite; acetoacetic acid arylamide type monoazo yellow pigments (Fast Yellow), e.g., C.I. Pigment Yellow 1, 3, 74, 97 and 98; acetoacetic acid arylamide type bisazo yellow pigments, e.g., C.I. Pigment Yellow 12,13 and 14; yellow dyes, e.g., C.I. Solvent Yellow 19, 77 and 79, and C.I. Disperse Yellow 164; red pigments, e.g., C.I. Pigment Red 8, 49:1, 53:1, 57:1, 81, 122, and 5; red dyes, e.g., C.I. Solvent Red 52, 58 and 8; copper phthalocyanine dyes and pigments and derivatives thereof or modified compounds thereof, e.g., C.I. Pigment Blue 15:3; and the like. In addition, colored or colorless sublimation dyes, conventional printing inks, and dyes and pigments well-known for other coloring purposes may also be used. These dyes and pigments may be used either individually or as a mixture of two or more thereof. As a matter of course, the dyes and pigments may be mixed with extender pigments or white pigments for color toning. For the purpose of improving dispersibility in binders, the colorant may be subjected to surface treatments such as with a surfactant, a coupling agent, such as a silane coupling agent, or a high polymeric material. High polymeric dyes or high polymer-grafted pigments may be used for the same purpose.

Binders generally employed in a heat-fusible ink layer can be used in the present invention with no particular restriction. Those having a melt viscosity of 2,500 to 200,000 cP at 100° C. are preferred. The binder is preferably used in an amount of 100 to 900 parts by weight per 100 parts by weight of the colorant.

Particularly preferred binders are one or more binders selected from the group consisting of isocyanate adducts of higher fatty acid polyhydric alcohol esters and ethylene-vinyl acetate copolymers.

The isocyanate adducts of higher fatty acid polyhydric alcohol esters are obtained by conventional methods known to those of ordinary sill in the art, such as by addition reaction between an isocyanate compound and an ester of a higher fatty acid (i.e., a $\geqq C_2$ fatty acid) and a polyhydric alcohol. Those having a melt viscosity of 2,500 to 50,000 cP (especially 4,000 to 20,000 cP) at 100° C. are preferred. Those having a melt viscosity less than 2,500 cP have weak cohesive force, tending to make it difficult to form a uniform transferred image. If the melt viscosity exceeds 50,000 cP, the ink layer tends to fail to be cut with sharp edges, only to provide a transferred image having poor resolution.

The higher fatty acids providing the ester with polyhydric alcohols include saturated fatty acids, unsaturated fatty acids, alicyclic fatty acids, oxygen-containing fatty acids, and hydroxy-fatty acids. These fatty acids have 2 to 60, preferably 5 to 50, more preferably 10 to 40, carbon atoms. Those containing 10 to 40 carbon atoms and having a melting point of 20° C. or higher are particularly recommended. Specific examples of these fatty acids include saturated fatty acids, such as capric acid, undecylic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, and lacceric acid; unsaturated fatty acids, such as acrylic acid, crotonic acid, isocrotonic acid, caproleinic acid, undecylenic acid, oleic acid, elaidic acid, cetoleic acid, erucic acid, brassidic acid, sorbic acid, linoleic acid, linolenic acid, arachidic acid, clupanodonic acid, herring acid, propiolic acid, and stearolic acid; branched fatty acids, such as isovaleric acid; alicyclic fatty acids, such as malva-phosphoric acid, sterculic acid, hydnocarpic acid, chaulmoogric acid, and gorlic acid; oxygen-containing fatty acids, such as sabinic acid, ipurolic acid, jalapinolic acid, juniperic acid, ricinoleic acid, and cerebronic acid; and hydroxy-fatty acids, such as 12-hydroxystearic acid. Among them, use of lanolin fatty acid obtained by saponifying lanolin secreted from the sebaceous glands of sheep is the most effective. These fatty acids may be used either individually or as a combination of two or more thereof.

The polyhydric alcohols providing the ester with the higher fatty acids include saturated aliphatic polyols, unsaturated aliphatic polyols, alicyclic polyols, and oxygen-containing aliphatic polyols. The polyols contain 1 to 50, preferably 1 to 20, more preferably 2 to 10, carbon atoms. Specific examples of suitable polyols are ethylene glycol, diethylene glycol, triethylene glycol, tetraethylene glycol, polyethylene glycol, propylene glycol, dipropylene glycol, polypropylene glycol, trimethylene glycol, butanediol, pentanediol, hexylenediol, octylenediol, glycerol, trimethylolpropane, pentaerythritol, dipentaerythritol, 1,3-butylene glycol, glycerol monoallyl, [4-(hydroxyethoxy) phenol]propane, sorbitol, neopentyl glycol, trishydroxyethyl isocyanurate, bisphenol, hydrogenated bisphenol, bisphenol glycol ether, and various epoxy compounds (e.g., triglycidyl isocyanurate). These polyhydric alcohols may be used either individually or as a combination of two or more thereof.

The isocyanate compound to be added to the higher fatty acid polyhydric alcohol esters includes monoisocyanates, diisocyanates, and triisocyanates. Specific examples of these isocyanate compounds include monoisocyanates, such as methyl isocyanate, ethyl isocyanate, n-propyl isocyanate, n-butyl isocyanate, octadecyl isocyanate, and polymethylene polyphenyl isocyanate; diisocyanates, such as 2,4-tolylene diisocyanate, 4,4'-diphenylmethane diisocyanate, dianisidine diisocyanate, m-xylylene diisocyanate, 1,5-naphthalene diisocyanate, trans-vinylene diisocyanate, N,N'-(4,4'-dimethyl-3,3'-diphenyl diisocyanate)uredion, and 2,6-diisocyanate methylcaproate; and triisocyanates, such as triphenylmethane triisocyanate and tris(4-phenylisocyanate thiophosphate)4,4', 4"-trimethyl-3,3',3"-triisocyanate-2,4,6-triphenylcyanurate. Diisocyanates and triisocyanates are particularly suitable, with aromatic isocyanate compounds being preferred. These isocyanate compounds may be used either individually or as a combination of two or more thereof.

The esterification between the higher fatty acid and the polyhydric alcohol can be carried out by any known technique. The degree of esterification is not particularly limited. The addition reaction of the isocyanate compound to the ester can be carried out by any known technique. While not limiting, the number of moles of the isocyanate compound added is preferably about 0.1 to 5 moles per mole of the ester. Commercially available isocyanated higher fatty acid polyhydric alcohol esters, such as LANOX FPK-210 produced by Yoshikawa Seiyu K.K., may be used in the present invention.

The ethylene-vinyl acetate copolymer which can be used as a binder preferably has a melt flow rate (MFR) of 5 to 2,000 dg/min, particularly 5 to 1,000 dg/min. If the MFR is less than 5 dg/min, the ink layer tends to fail to be cut with sharp edges, only to provide a transferred image having poor resolution. If the MFR exceeds 2,000 dg/min, an ink flow tends to occur, failing to achieve normal and uniform thermal transfer recording.

The ethylene-vinyl acetate copolymer is preferably used in an amount of 10 to 900 parts by weight per 100 parts by weight of the above-described isocyanate polymer. If the amount of the ethylene-vinyl acetate copolymer is less than 10 parts by weight, background staining tends to occur. If it exceeds 900 parts by weight, transferred images tend to have insufficient abrasion resistance and the recording sensitivity tends to be reduced, which may cause reduction in resolution in high-speed printing.

If desired, the heat-fusible ink layer may contain other binders. Suitable binders include homopolymers of styrene or a derivative or substituted product thereof, methacrylic acid or an ester thereof, acrylic acid or an ester thereof, a diene compound, and a vinyl monomer; copolymers of these monomers and other comonomers (inclusive of random copolymers, alternate copolymers, block copolymers, and interpenetrating copolymers); and other resins, such as polycarbonate resins, polyester resins, silicone resins, fluorine-containing resins, phenolic resins, terpene resins, petroleum resins, hydrogenated petroleum resins, alkyd resins, ketone resins, and cellulose derivatives. These binders may be used either individually or as a polymer blend of two or more thereof prepared by melt mixing or mechanical mixing. Polymer blends prepared by polymerization in the presence of a comonomer or multi-stage polymerization for obtaining a polymer or an oligomer may also be used. Vinyl polymers may be used as crosslinked polymers prepared by using a polyfunctional monomer, such as divinylbenzene. These other binders are preferably used in an amount of up to 100 parts by weight per 100 parts by weight of the colorant.

If desired, the heat-fusible ink layer may contain waxes, oils, liquid plasticizers or resins which have been used as heat-fusible substances in conventional thermal transfer recording media. In addition, the heat-fusible ink layer or other layers may contain homo- or copolymers of olefins (e.g., ethylene or propylene), organic acid-grafted olefin copolymers, chlorinated paraffins, low-molecular urethane compounds, plasticizers that are solid at room temperature, charge control agents and/or antistatic agents (e.g., surface active agents), electroconductivity imparting agents, antioxidants, thermal conductivity improvers, magnetic substances, ferroelectric substances, antiseptics, flavors, antiblocking agents, reinforcing fillers, releasing agents, foaming agents, sublimation substances, infrared absorbers, and the like.

While not limiting, the heat-fusible ink layer preferably has a thickness of about 0.1 to 10 μm, more preferably of 0.1 μm or more and less than 5.0 μm. In a particularly preferred embodiment, the heat-fusible ink layer has a smaller thickness than usual, i.e., of 0.1 μm or more and less than 5.0 μm, the substrate has a smaller thickness than usual, i.e., of 0.5 μm or more and less than 3.0 μm, and the wax release layer has a thickness of 0.1 μm or more and less than 3.0 μm. In this case, not only is transfer sensitivity improved but running stability of the thermal transfer recording medium is further improved. This preferred embodiment is especially effective where an ink ribbon in an ink ribbon cassette which is run at a high speed.

The thermal transfer recording medium of the present invention may have a back coat layer on the substrate on the side opposite to the heat-fusible ink layer for the purpose of improving heat resistance or running properties. A back coat layer is particularly advantageous for recording with a thermal head.

The back coat layer is conventionally known to those of ordinary skill in the art and is generally formed of nitrocellulose compounds, silicone compounds or fluorine-containing compounds. The back coat layer is preferably formed of a reaction product between an amino-modified silicone oil (e.g., dimethylpolysiloxane having an amino group introduced to part of its methyl group) with a polyfunctional isocyanate compound (e.g., tolylene diisocyanate) or a silicone-butyral resin. While not limiting, the back coat layer preferably has a thickness of 0.01 to 0.5 μm.

The thermal transfer recording medium of the present invention may further have an overcoat layer or a resistive layer for electric resistance heating.

A preferred process for producing the thermal transfer recording medium will be described below. To begin with, the above-mentioned wax component is applied to a substrate to form a wax release layer by a conventional method known to those of ordinary skill in the art. While not limiting, the wax component is applied by means of, for example, a wire coater.

The wax release layer formed on the substrate is then coated with a heat-fusible ink coating composition to form a heat-fusible ink layer.

The ink coating composition is prepared by conventional method known to those of ordinary skill in the art such as by dissolving or dispersing the above-mentioned binders in a solvent or a dispersion medium capable of dissolving or stably dispersing the binders to prepare a solution or an emulsion, and a colorant is dispersed therein by means of a dispersive blender, such as a ball mill, a sand mill, an attritor, a dynomill, a three-roll mill, etc. After colorant dispersion, fine particles may be added thereto, followed by mixing by stirring in a homomixer, a disper, a dissolver, etc. The coating composition may be prepared by molten mixing in a three-roll, a kneader, a sand mill, an attritor, etc. without using a solvent or a dispersion medium.

The resulting heat-fusible ink coating composition is applied to the wax release layer by solution coating or melt coating by means of a gravure coater, a wire bar coater, etc. The coating composition may be powdered by spray drying and applied to the wax release layer by powder coating, such as electrostatic coating. After powder coating, the coating layer may be subjected to fixing treatment, such as a heat treatment, a pressure treatment, or a solvent treatment.

The present invention will now be illustrated in greater detail with reference to Examples, but it should be understood that the present invention is not limited thereto. Unless otherwise indicated, all the parts and percents are by weight.

EXAMPLE 1

In toluene were dispersed 95 parts of candelilla wax (TOKUSEI TOKUGO produced by Noda Wax K.K.; melt viscosity at 100° C.: 14 cP; dropping point (ASTM D-3104): 72° C.) and 5 parts of an ethylene-vinyl acetate copolymer in a ball mill to prepare a release layer coating composition. The coating composition was applied to a 2.5 μm-thick polyethylene terephthalate (PET) film having a silicone back coat by means of a wire bar coater to form a 1.0 μm-thick thermoplastic release layer.

The following components were dispersed in a ball mill for 20 hours to prepare a heat-fusible ink composition having a solids content of 20%.

| Formulation of Heat-Fusible Ink: | |
|---|---|
| Carbon black (colorant) | 40 parts |
| Ethylene-vinyl acetate copolymer EV 260 (MFR: 5 dg/min) | 30 parts |
| Isocyanate adduct of lanolin fatty acid polyhydric alcohol ester (melt viscosity at 100° C.: 5000 cP) | 30 parts |
| Toluene (solvent) | 400 parts |

The resulting ink composition was applied to the release layer with a wire bar coater and dried to remove the solvent. There was thus obtained a thermal transfer recording medium having a 2 μm-thick heat-fusible ink layer.

A probe tack test specified in ASTM D2979 was applied to the resulting thermal transfer recording medium under the above-described measuring conditions. As a result, the maximum probe tack in a temperature range of 40° to 150° C. was 50 gf.

The thermal transfer recording medium was cut to a width of 12.7 mm and put into an ink ribbon cassette. A serial thermal printer (FW-U1P95, 360 dpi, manufactured by Matsushita Electric Industrial Co., Ltd.) was loaded with the ink ribbon cassette, and printing was carried out on plain paper (Bekk's smoothness: 160 sec). In order to examine the relationship between printing energy and transferred image density, the transferred image density was measured with a Macbeth densitometer (RD 514 Model) while varying the applied voltage from 30.0 and 36.5 V by operating a density control lever. As a result, the voltage necessary for obtaining an image having a density of 1.2 was 33 V. No background stains were observed on printing. The ink ribbon showed satisfactory running properties.

EXAMPLE 2

A thermal transfer recording medium was prepared in the same manner as in Example 1, except for forming the release layer of 95 parts of paraffin wax (HNP-10 produced by Nippon Seiro Co., Ltd.; melt viscosity at 100° C.: 8 cP; dropping point (ASTM D-3104): 75° C.) and 5 parts of an ethylene-vinyl acetate copolymer.

The thermal transfer recording medium was cut to a width of 12.7 mm, and the resulting ink ribbon was put into an ink ribbon cassette.

The ink ribbon cassette was subjected to the same printing test as in Example 1. As a result of a density measurement with a Macbeth densitometer (Model RD 514) after transfer recording, the voltage required for obtaining a density of 1.2 was found to be 33.5 V. The maximum probe tack in a range of 40° to 150° C. was 40 gf. The running properties of the ink ribbon was particularly satisfactory.

EXAMPLE 3

A thermal transfer recording medium and an ink ribbon cassette were prepared in the same manner as in Example 1, except for forming the release layer of 95 parts of low-molecular polyethylene wax (Polywax 655, produced by Toyo Petrolite Co., Ltd.; melt viscosity at 100° C.: 6 cP; dropping point (ASTM D-3104): 87° C.) and 5 parts of an ethylene-ethyl acrylate copolymer.

The ink ribbon cassette was subjected to the same printing test as in Example 1. As a result of a density measurement with a Macbeth densitometer (Model RD 514) after transfer recording, the voltage required for obtaining a density of 1.2 was 34 V. The maximum probe tack in a range of 40° to 150° C. was 40 gf. The running properties of the ink ribbon was particularly satisfactory.

COMPARATIVE EXAMPLE 1

A thermal transfer recording medium and an ink ribbon cassette were prepared in the same manner as in Example 1, except for forming the release layer (thickness: 1 μm) of 95 parts of microcrystalline wax (Hi-Mic-3090, produced by Nippon Seiro Co., Ltd.; melt viscosity at 100° C.: 17 cP; dropping point (ASTM D-3104): 89° C.) and 5 parts of an ethylene-vinyl acetate copolymer and changing the thickness of the PET film to 2 μm (thickness of heat-fusible ink layer: 2 μm).

The ink ribbon cassette was subjected to the same printing test as in Example 1. As a result of a density measurement with a Macbeth densitometer (Model RD 514) after transfer recording, the voltage required for obtaining a density of 1.2 was 36 V. The maximum probe tack in a range of 40° to 150° C. was 80 gf. The ink ribbon showed instable running particularly in the very beginning of printing.

COMPARATIVE EXAMPLE 2

A thermal transfer recording medium and an ink ribbon cassette were prepared in the same manner as in Example 1, except for forming the release layer (thickness: 1 μm) of 95 parts of carnauba wax (SEISEI No. 1, produced by Noda Wax K.K.; melt viscosity at 100° C.: 27 cP; dropping point (ASTM D-3104): 83° C.) and 5 parts of an ethylene-vinyl acetate copolymer and changing the thickness of the PET film to 2 μm (thickness of heat-fusible ink layer: 2 μm).

The ink ribbon cassette was subjected to the same printing test as in Example 1. As a result of a density measurement with a Macbeth densitometer (Model RD 514) after transfer recording, the voltage required for obtaining a density of 1.2 was 36.5 V. The maximum probe tack in a range of 40° to 150° C. was 110 gf. The ink ribbon showed instable running particularly in the very beginning of printing.

COMPARATIVE EXAMPLE 3

A thermal transfer recording medium and an ink ribbon cassette were prepared in the same manner as in Example 1, except for forming the release layer (thickness: 1 μm) of 95 parts of polyethylene wax (Polywax 2000, produced by Toyo Petrolite Co., Ltd.; melt viscosity at 149° C.: 48 cP; dropping point (ASTM D-3104): 125° C.) and 5 parts of an ethylene-ethyl acrylate copolymer and changing the thickness of the PET film to 2 μm (thickness of heat-fusible ink layer: 2 μm).

The ink ribbon cassette was subjected to the same printing test as in Example 1 but failed to provide a transferred image having a density of 1.2. The maximum probe tack in a range of 40° to 150° C. was 190 gf. The ink ribbon had unstable running properties.

As is apparent from the results in the foregoing Examples in view of Comparative Examples, the thermal transfer recording media prepared in Examples 1 to 3, having a maximum probe tack of 0.1 to 60 gf in a range of 40° to 150° C., exhibit improved transfer sensitivity in printing, thereby improving durability and print quality of the transferred image.

On the other hand, the transfer sensitivity of the thermal transfer recording media of Comparative Examples 1 to 3, whose maximum probe tack was out of the range of 0.1 to 60 gf in a range of 40° to 150° C., is not high.

According to the present invention, the release properties of the heat-fusible ink layer are improved by controlling the maximum probe tack of the wax release layer in a range of 40° to 150° C. within a range of from 0.1 to 60 gf. As a result, the transfer sensitivity on printing is improved, which brings about improved durability of a transferred image and improved print quality. The running properties of the medium are also improved.

Where a wax component having a melt viscosity of less than 15 cP is used in the wax release layer, the improvement in release characteristics of the wax release layer is further ensured, which brings about a further improvement in running properties, particularly in low energy printing.

In addition, with the thicknesses of the substrate, heat-fusible ink layer and wax release layer being adjusted to specific ranges, the improvement in release properties is further ensured, which brings about further improved running properties in low energy printing. In this case, since the whole thickness of the recording medium can be reduced, the printing capacity per ink ribbon cassette is so increased to offer an economical advantage.

While the invention has been described in detail and with reference to specific embodiments thereof, it will be apparent to one skilled in the art that various changes and modifications can be made therein without departing from the spirit and scope thereof.

This application is based on Japanese Patent Application Hei-7-62593, filed in Japanese Patent Office on Mar. 22, 1995, the entire contents of which are hereby incorporated by reference.

Obviously, numerous modifications and variations of the present invention are possible in light of the above teachings. It is therefore to be understood that within the scope of the appended claims, the invention may be practiced otherwise than as specifically described herein.

What is claimed is:

1. A thermal transfer recording medium comprising a substrate having thereon a wax release layer and a heat-fusible ink layer provided on said wax release layer, wherein said wax release layer has a maximum probe tack of from 0.1 to 60 gf in a temperature range of 40° to 150° C. as measured in accordance with ASTM D2979 and wherein said wax release layer has a dropping point of not higher than 100° C. as measured according to ASTM D-3104.

2. The thermal transfer recording medium of claim 1, wherein said wax release layer comprises at least one wax component selected from the group consisting of polyethylene wax, paraffin wax and a mixture thereof.

3. The thermal transfer recording medium of claim 1, wherein said heat-fusible ink layer comprises at least one binder selected from the group consisting of an isocyanate adduct of a $C_{2-60}$ higher fatty acid polyhydric alcohol ester, an ethylene-vinyl acetate copolymer and a mixture thereof.

4. The thermal transfer recording medium of claim 1, wherein said substrate has a thickness of about 0.5 μm or more and less than 3.0 μm, and said wax release layer has a thickness of 0.1 μm or more and less than 3.0 μm.

5. The thermal transfer recording medium of claim 1, wherein said ink layer has a thickness of 0.1 μm or more and less than 5.0 μm.

6. The thermal transfer recording medium of claim 1, wherein said substrate has a thickness of 0.5 μm or more to less than 3.0 μm, said wax release layer has a thickness of 0.1 μm or more to less than 3.0 μm and said heat-fusible ink layer has a thickness of 0.1 μm or more to less than 5.0 μm.

7. The thermal transfer recording medium of claim 1, wherein said wax release layer has a melt viscosity at 100° C. of less than 15 cp.

8. The thermal transfer recording medium of claim 1, wherein said wax release layer comprises:

a) 1 to 100% by weight of a wax component; and b) 0 to 50% by weight of a resin component selected from the group consisting of ethylene-vinyl acetate copolymer, ethylene-acrylic acid copolymer, polyethylene resin, petroleum resin and a mixture thereof.

9. The thermal transfer recording medium of claim 1, wherein said heat-fusible ink layer comprises:

a) a colorant; and b) a binder.

10. The thermal transfer recording medium of claim 9, wherein said binder has a melt viscosity of 2,500 to 200,000 cp at 100° C.

11. The thermal transfer recording medium of claim 9, wherein said heat-fusible ink layer comprises:

a) 100 parts by weight of colorant; and b) 100 to 900 parts by weight of a binder.

12. The thermal transfer recording medium of claim 9, wherein said binder is selected from the group consisting of an isocyanate adduct of a $C_{2-60}$ fatty acid polyhydric alcohol ester, an ethylene-vinyl acetate copolymer and a mixture thereof.

13. The thermal transfer recording medium of claim 1, further comprising a back coat layer on said substrate on a side opposite to said heat-fusible ink layer.

14. An ink ribbon cassette comprising a thermal transfer recording medium comprising a substrate having thereon a wax release layer, and a heat-fusible ink layer provided on said wax release layer, wherein said wax release layer has a maximum probe tack of from 0.1 to 60 gf in a temperature range of 40° to 150° C. as measured in accordance with ASTM D2979 and wherein said wax release layer has a dropping point of not higher than 100° C. as measured in according to ASTM D-3104.

15. A method of thermal transfer recording comprising:

a) contacting a heat-fusible ink layer of a thermal transfer recording medium with a transferee material;

b) melting said heat-fusible ink layer by applying heat from a substrate side of said thermal transfer recording medium; and c) transferring an ink image to said transferee material, wherein said thermal transfer recording medium is the thermal transfer recording medium of claim 1.

* * * * *